United States Patent [19]

McTighe et al.

[11] 3,989,065

[45] Nov. 2, 1976

[54] LIQUID TRANSFER APPARATUS

[75] Inventors: Gilbert McTighe; Robert T. McTighe, both of Mitchell, S. Dak.

[73] Assignee: McTighe Industries, Inc., Mitchell, S. Dak.

[22] Filed: Apr. 20, 1973

[21] Appl. No.: 353,096

[52] U.S. Cl. ..... 137/615

[51] Int. Cl.[2] ..... F17D 1/00

[58] Field of Search ..... 137/615; 285/94, 168, 285/181

[56] References Cited

UNITED STATES PATENTS

| | | | |
|---|---|---|---|
| 1,574,211 | 2/1926 | Taylor | 285/94 X |
| 2,360,345 | 10/1944 | Hilkemeier | 285/94 X |
| 2,466,025 | 4/1949 | Hanson | 285/94 X |
| 2,770,475 | 11/1956 | Rafferty | 285/94 |
| 2,861,532 | 11/1958 | Ault | 137/615 X |
| 3,021,867 | 2/1962 | Gallagher | 137/615 X |
| 3,217,747 | 11/1965 | Joanis et al. | 137/614.11 X |
| 3,249,121 | 5/1966 | Bily | 137/615 |
| 3,381,711 | 5/1968 | Fye et al. | 137/615 |

*Primary Examiner*—Charles J. Myhre
*Assistant Examiner*—Ira S. Lazarus
*Attorney, Agent, or Firm*—Bacon & Thomas

[57] ABSTRACT

A fluid transfer apparatus for transferring gasoline, for example, to a bottom loading tank truck wherein a standpipe, rotatable about its vertical axis, is journalled at its upper end on an overhead support so that a rotary gland swivel at its bottom need be designed to support only the weight of the apparatus without having to resist bending moments. An articulated conduit assembly and counterbalance are mounted on the standpipe and rotate therewith throughout complete rotations about the vertical axis.

3 Claims, 3 Drawing Figures

LIQUID TRANSFER APPARATUS

BACKGROUND OF THE INVENTION

This invention is in the field of liquid transfer apparatus for transferring liquids from a supply source to a vehicle of the bottom loading type.

The American Petroleum Institute has established limits and has specified that apparatus of the type disclosed herein must provide for moving a connector valve through which fluids are to be transferred to a bottom loading truck throughout an area 3'6" high by 8' wide with the height to the center line of the coupler 2'9" above the grade level. Such limitations are not in themselves difficult to maintain but heretofore it has been the practice to construct transfer apparatus of relatively heavy components capable of standing erect solely by virtue of a swivel connection at the base. The necessity for counterbalancing horizontal and drop arms has added to the strength requirements, thus rendering previous devices quite bulky and expensive and in many cases necessitated the provision of power means to manipulate the mechanism.

SUMMARY OF THE INVENTION

The present invention meets the requirements of the American Petroleum Institute with relatively light and inexpensive components by providing an upstanding conduit swivelled at its bottom to a connection leading to a supply tank or the like and wherein the upstanding conduit is journalled at its upper end to an overhead fixed support, thus relieving the upstanding conduit or its bottom swivel from substantially all bending forces, the requirement being only that the swivel be capable of sustaining the weight of the apparatus applied vertically thereto. The arrangement is such that the entire apparatus can swing about the vertical axis of the upstanding conduit throughout 360°, thus rendering it readily available for successive loadings without the necessity of moving a first truck out of the way to place another in loading position.

DESCRIPTION OF A PREFERRED EMBODIMENT

Figure 1:
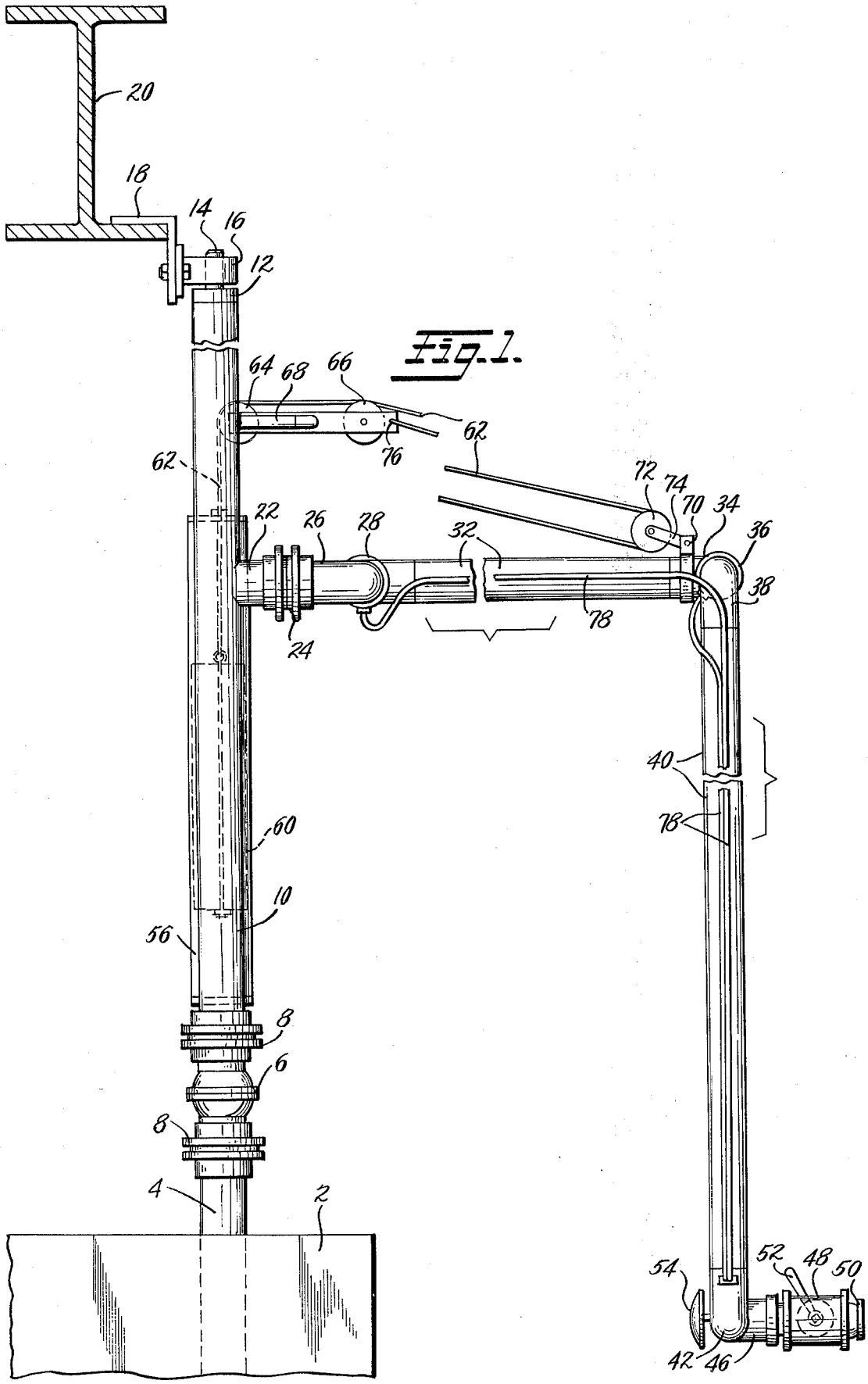
FIG. 1 is a fragmentary and somewhat schematic front elevational view of the fluid transfer apparatus of the present invention.

Referring to the drawings, numeral 2 indicates schematically a suitable base in appropriate relation to a supply tank of fluid, such as gasoline, for example, to be transferred to a bottom loading truck, not shown.

A standpipe 4 leads from the supply tank to a swivel coupling 6 of known construction. The swivel coupling 6 may be attached by flanges 8 to the standpipe 4 and to an upstanding conduit 10. Such swivels are of known construction and need not be described in greater detail except to point out that the swivel 6 permits free rotation of the upstanding conduit 10 about its vertical axis while maintaining a proper fluid seal between the standpipe 4 and the upstanding conduit 10.

At its upper end the upstanding conduit 10 is closed by a suitable fixture 12 providing a trunion 14 which is journalled in a bearing 16 about the vertical axis of the upstanding pipe 10. The bearing 16 is supported by a bracket 18 fixedly mounted to a fixed overhead support schematically illustrated by the I-beam 20.

Figure 2:
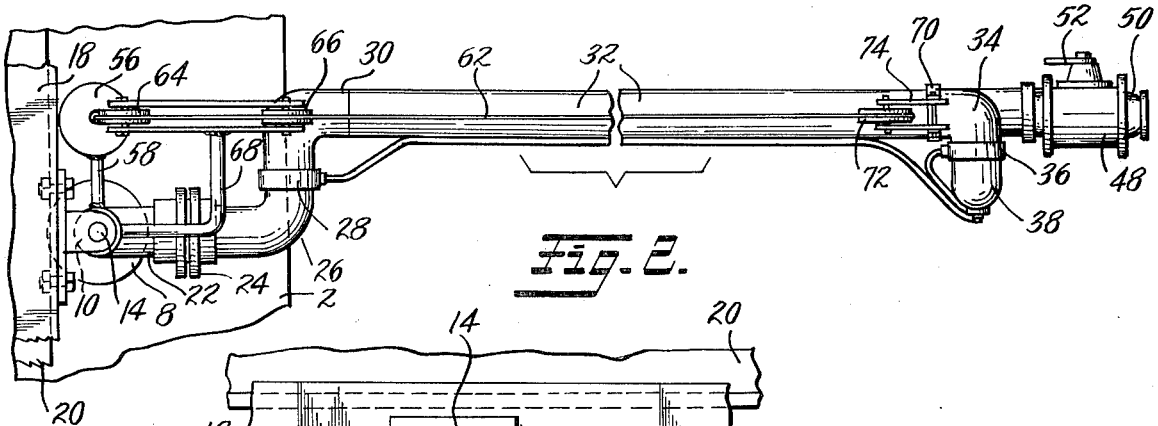
FIG. 2 is a fragmentary plan view of the apparatus of FIG. 1.
Figure 3:
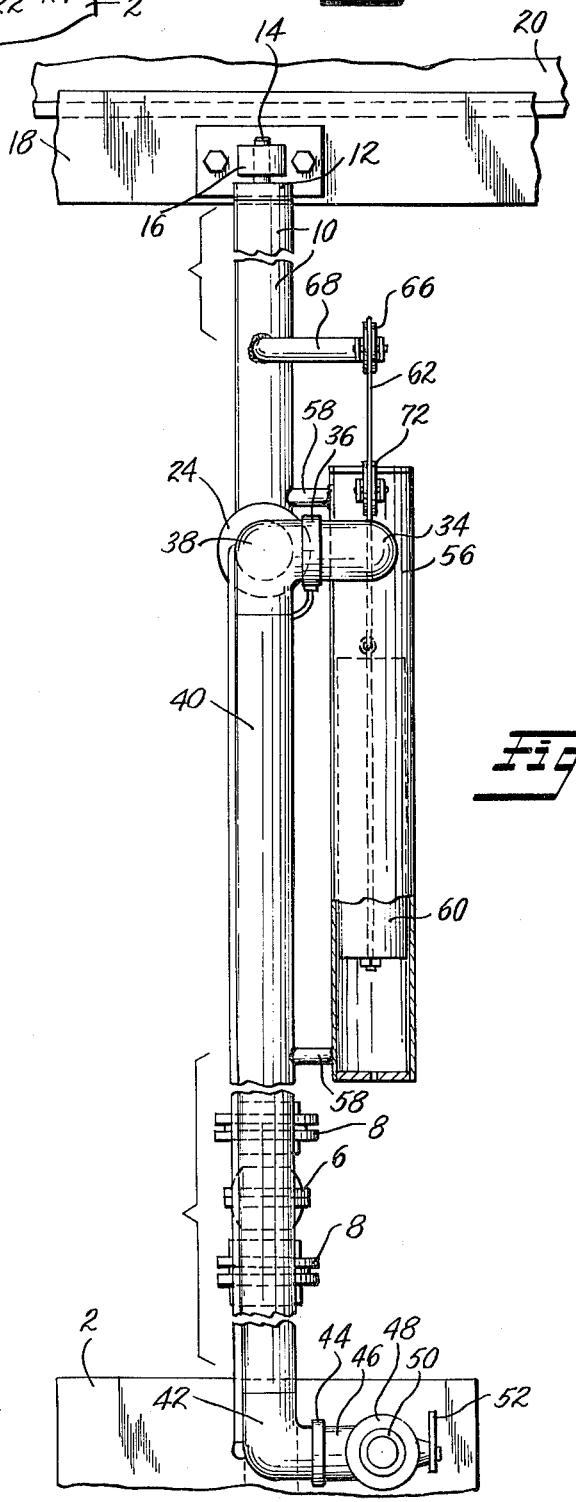
FIG. 3 is a fragmentary side elevational view, partly in section, of the apparatus of FIGS. 1 and 2, as viewed from the right thereof.

Intermediate its length the upstanding conduit 10 is provided with a lateral branch 22 connected by a suitable swivel gland 24 to an ell 26 comprising a right angularly bent fitting of known construction. The ell (elbow) 26 is further swivelled by a suitable gland structure 28 (FIG. 2) to a second ell fitting 30 secured to the end of a generally horizontally extending conduit 32. Thus, the swivel gland 24 provides for rotation about a horizontal axis perpendicular to the conduit 10 while the gland 28 provides for up and down pivoting of conduit 32 to raise or lower its outer end. Thus, the horizontal arm or boom 32 is free for pivotal movements in a vertical plane or about a horizontal axis in addition to being swingable about the vertical axis defined by the swivel fitting 6 and trunion 14. Its outer end is, therefore, capable of substantially universal movement.

The outer end of the horizontal conduit 32 is also formed to define an ell 34 joined by a swivel gland 36 to an ell 38 fixed to the upper end of a drop pipe or conduit 40 extending downwardly therefrom. It will thus be apparent that the drop conduit 40 is free to swing in substantially any direction or to be moved vertically upwardly or downwardly. The lower end of the drop conduit 40 is formed to define a further ell 43 joined by rotary gland 44 to a lower ell 46 which carries a coupler valve 48 thereon. The coupler valve 48 may be of known construction, including a coupler end portion 50 adapted to be received in a complementary coupling fitting on a tank truck or the like. Such known fittings are the type wherein the coupling 48 is merely inserted in the complementary portion on the truck and pressed inwardly thereof to effect a proper coupling whereupon handle 52 may be manipulated to open the coupling valve and effect transfer of fluid from the supply tank, previously mentioned, to the truck. To facilitate connection of the coupling 48 to the corresponding coupling on the truck, a presser plate 54 is mounted on the ell 46 substantially directly behind the coupler 48 so that the operator need merely align the coupling valve elements and lean heavily against the presser plate 54 to exert the pressure necessary to effect a proper coupling.

When the apparatus is in operation, it will be apparent that the weight of the generally horizontal conduit 32, the drop conduit 40 and the components mounted thereon, along with the weight of the liquid filling the conduits 32 and 40 is quite substantial. To render the device more readily operable by a single operator, there is provided a counterweight guide tube 56 mounted on brackets 58 whereby the tube 56 is fixedly mounted on one side of the upstanding conduit 10 and rotatable therewith. A counterbalance weight 60 is freely slidable in the guide tube 56 and is attached to cable 62 extending over the first pulley 64 and a second pulley 66, both mounted on a bracket 68 likewise secured to the upstanding conduit 10. The outer end of the generally horizontal conduit 32 is provided with a bracket 70 to which a pulley 72 is journalled by means of a swingable link 74. The cable 62 is trained over guide pulleys 64 and 66, then trained around pulley 72, back to the bracket structure 68 to which it is attached as at 76. The weight of the counterbalance 60 is such that it will counterbalance the weight of conduits 32 and 40 and their attachments along with the weight of the liquid contents in those conduits, when the device is in operation.

From the structure thus far described it will be apparent that such apparatus may be installed for operation without the necessity of providing an attendant. The driver of a truck may pull his vehicle to within a reasonable distance of the apparatus, on any side thereof and he may swing the components of the articulated conduit system 32–40 around to align with the receiver on his vehicle tank; he can then single-handedly effect connection of the coupler 48 to the vehicle and effect loading thereof. At the same time another truck may be positioned adjacent the apparatus on another side thereof for receiving material from the supply tank as soon as the first vehicle is loaded and without having to wait for the first vehicle to pull away froma single loading site.

Since the upstanding conduit 10 is journalled at its upper end to the fixed support 20, the eccentric weight of the articulated conduit system does not apply any bending movements to the swivel 6 or standpipe 4 and the latter need only be sufficiently rugged to support the weight of the apparatus as applied vertically thereto.

Since it is contemplated that the described apparatus may be manipulated without an attendant, it is advisable that the swivel glands theretofore described be properly lubricated at all times. For this purpose, a plurality of small conduits 78 are mounted on the apparatus for conducting lubricant from a remote source (not shown) to the various swivel glands referred to.

While a single specific embodiment of the invention has been shown, it is to be understood that the same is merely exemplary of the principles involved and other forms may be resorted to within the scope of the appended claims.

We claim:

1. A liquid transfer apparatus comprising:

an upstanding conduit in communication with a supply of fluid to be transferred; first swivel means, adjacent the bottom thereof, and mounting said upstanding conduit for rotation about its upstanding axis relative to said supply;

articulated conduit means carried by said upstanding conduit and extending laterally therefrom between the upper end thereof and said first swivel means;

a fixed overhead support above said upstanding conduit;

means journalling the upper end of said upstanding conduit to said support, the region laterally of said conduit, in all directions, being free of any obstruction whereby said transfer apparatus may rotate through at least a complete turn about said upstanding axis, said articulated conduit means including a generally horizontal conduit swiveled to said upstanding conduit;

upstanding guide means secured to a side of said upstanding conduit;

a counterweight movable along said upstanding guide means; and cable means connecting said counterweight to said horizontal conduit outwardly of said upstanding conduit to counterbalance said articulated conduit means and fluid contents thereof throughout all positions of rotation of said transfer apparatus about said axis.

2. A liquid transfer apparatus as defined in claim 1 wherein said articulated conduit means includes a drop conduit swiveled to the outer end of said horizontal conduit to extend downwardly therefrom and connector valve means swiveled to the lower end of said drop conduit and being of the type connectable to a receiver for fluid from said supply by pressing the same to said receiver; and presser plate means secured to said connector valve and defining a surface facing outwardly therefrom whereby an operator may apply body pressure thereto to connect said valve to said receiver.

3. A liquid transfer apparatus as defined in claim 2 wherein said conduits and connector valve are swiveled, as stated, by relatively rotatable members; and further conduit means carried by said conduits of said apparatus for directing a lubricant, from a remote source, to said relatively rotatable members.

* * * * *